US010663261B2

(12) United States Patent
Summerfield et al.

(10) Patent No.: US 10,663,261 B2
(45) Date of Patent: May 26, 2020

(54) SCOPE MOUNT WITH ELECTRICAL CONNECTIVITY HUB

(71) Applicant: Lightforce USA, Inc., Orofino, ID (US)

(72) Inventors: Abram W. Summerfield, Orofino, ID (US); Corey Q. Runia, Orofino, ID (US)

(73) Assignee: Lightforce USA, Inc., Orofino, ID (US)

( * ) Notice: Subject to any disclaimer, the term of this patent is extended or adjusted under 35 U.S.C. 154(b) by 0 days.

(21) Appl. No.: 16/000,959

(22) Filed: Jun. 6, 2018

(65) Prior Publication Data

US 2018/0364008 A1 Dec. 20, 2018

Related U.S. Application Data

(60) Provisional application No. 62/522,229, filed on Jun. 20, 2017.

(51) Int. Cl.

| | |
|---|---|
| ***F41G 11/00*** | (2006.01) |
| ***F41G 1/387*** | (2006.01) |
| ***F41G 1/473*** | (2006.01) |
| ***F41G 1/44*** | (2006.01) |

(52) U.S. Cl.
CPC ..... *F41G 11/003* (2013.01); *F41G 1/387* (2013.01); *F41G 1/44* (2013.01); *F41G 1/473* (2013.01)

(58) Field of Classification Search
CPC ..... F41G 1/387
See application file for complete search history.

(56) References Cited

U.S. PATENT DOCUMENTS

| | | | | |
|---|---|---|---|---|
| 5,033,219 | A | 7/1991 | Johnson et al. | |
| 6,244,261 | B1 | 6/2001 | West, Jr. | |
| 6,722,074 | B1 * | 4/2004 | Farrell | F41G 11/003 42/124 |
| 7,841,120 | B2 | 11/2010 | Teetzel et al. | |
| 8,230,636 | B1 * | 7/2012 | Swan | F41G 11/003 33/263 |
| 8,939,366 | B1 | 1/2015 | Kelly | |
| 9,052,153 | B2 | 6/2015 | Oh et al. | |
| 9,200,867 | B1 * | 12/2015 | Swan | F41G 11/003 |
| 9,250,036 | B2 | 2/2016 | Farca et al. | |
| 9,323,061 | B2 | 4/2016 | Edwards et al. | |

(Continued)

FOREIGN PATENT DOCUMENTS

| | | | |
|---|---|---|---|
| EP | 1772695 | A1 | 4/2007 |
| WO | 2015048889 | A1 | 4/2015 |

OTHER PUBLICATIONS

U.S. Patent and Trademark Office; Search Report in related International Patent Application No. PCT/US2018/036178 dated Jun. 6, 2018; 7 pages.

*Primary Examiner* — Gabriel J. Klein
(74) *Attorney, Agent, or Firm* — Wood Herron & Evans LLP

(57) ABSTRACT

An optical aiming scope mount (10) includes a base (12) configured to attach to a weapon system. At least two longitudinally spaced apart scope mounting rings (14, 16) are on the base. A first chamber (34) is formed in a portion of the base (12). A plurality of electrical connectors (38) on the base (12) are operatively joined by a circuit (46) at least partially located in the first chamber (34) to provide a power/data distribution bus.

16 Claims, 3 Drawing Sheets

(56) References Cited

U.S. PATENT DOCUMENTS

| | | | | |
|---|---|---|---|---|
| 9,383,167 | B1 * | 7/2016 | Connolly | F41G 11/003 |
| 9,488,436 | B2 | 11/2016 | Abst | |
| 9,823,043 | B2 * | 11/2017 | Compton | F41G 11/003 |
| 2003/0195046 | A1 | 10/2003 | Bartsch | |
| 2004/0055201 | A1 * | 3/2004 | Wolfe | F41G 11/002 42/124 |
| 2010/0083553 | A1 | 4/2010 | Montgomery | |
| 2010/0218410 | A1 | 9/2010 | Cabahug et al. | |
| 2012/0097741 | A1 | 4/2012 | Karcher | |
| 2013/0061504 | A1 | 3/2013 | Malherbe et al. | |
| 2013/0152445 | A1 | 6/2013 | Compton et al. | |
| 2013/0194435 | A1 | 8/2013 | Lupher et al. | |
| 2013/0279013 | A1 | 10/2013 | Edwards et al. | |
| 2013/0283663 | A1 * | 10/2013 | Joplin | F41G 11/003 42/124 |
| 2014/0047754 | A1 * | 2/2014 | Compton | F41C 27/00 42/84 |
| 2014/0190062 | A1 * | 7/2014 | Turner, Jr. | F41G 11/003 42/124 |
| 2014/0245650 | A1 | 9/2014 | Abst | |
| 2015/0020427 | A1 | 1/2015 | Compton et al. | |
| 2015/0041538 | A1 | 2/2015 | Teetzel et al. | |
| 2016/0018185 | A1 * | 1/2016 | Makohon | F41G 11/001 42/90 |
| 2016/0069644 | A1 | 3/2016 | Bell | |

* cited by examiner

SCOPE MOUNT WITH ELECTRICAL CONNECTIVITY HUB

RELATED APPLICATIONS

This application claims priority to U.S. Provisional Patent Application No. 62/522,229, filed Jun. 20, 2017, and incorporates the same herein by reference.

TECHNICAL FIELD

This invention relates to a riflescope mount that provides electrical connectivity of multiple devices, such as a riflescope display, laser rangefinder, remote controls, battery power supply, environmental sensors, and communication devices.

BACKGROUND

The use of electrical devices to assist in aiming a rifle to hit a long-range target, both by hunters and on the battlefield, has become increasingly common. Many of these devices are used with or integrated into a riflescope that provides magnified optical sighting and an aiming reticle. These devices can include a riflescope display, laser rangefinders, remote control buttons, environmental sensors, communication devices, and ballistic calculators. All of these devices require electrical power and data communication with each other, whether wired or wireless. Wireless communication requires additional power, standardized communications protocols to connect with selected devices while not interfering with other nearby devices, and that each device be separately powered. Wired connections can reduce power requirements, reduce interference with other devices, and can share both power and data connectivity using a bus system. Such connecting wires, however, require specialized end connectors and are rarely the exact length necessary for most efficient connection. "Splitter" cables have been used to facilitate connectivity, but are often also longer than needed and require the user to loop, wrap, tape, or zip-tie extra wire to prevent snagging during use.

Systems have been proposed that integrate power and data connectivity into accessory mounting rails (Picatinny or MIL-STD 1913). Representative examples of such diverse systems are shown in U.S. Pat. No. 9,488,436; in U.S. Patent Application Publication Nos. 2010/0083553A1, 2010/0192443A1, 2010/0218410A1, 2013/0061504A1, 2014/0047754A1, and 2015/0020427A1; and in WIPO International Publication No. WO 2015/048889 A1. These provide integral, exposed contacts that interface with specialized mounts incorporated into the devices or require specialized mounts that connect to the integral rail contacts and then provide a wire connection jack for the device. Another proposed rail system, described in U.S. Patent Application Publication No. 2013/0152445, transfers power by induction. Several such electrical connectivity mounting rail systems have been proposed, but none has been adopted as a standard. Furthermore, such a system requires that all devices to be connected be replaced with one having the specialized interface or the use of an adapter. Either of these options significantly adds to the cost of a weapon system, which creates a further barrier to adoption.

SUMMARY

This invention provides a scope mount without any compromise to its mechanical features provides an electrical hub or data and power distribution bus. In one embodiment, it houses electrical connections that can be used for a riflescope display, laser rangefinder, ballistics computer, environmental sensors, and/or communication or control devices. Compartments for housing batteries can be housed in the base, as well as compartments for circuit boards where environmental sensors may be mounted away from heat sources, Bluetooth®, GPS, or other antennas may be mounted for maximum communication distance or for least interference. Single run, short cables can be used to provide wired connections at a lower cost and reduced management burden compared to long, complicated splitter cables.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
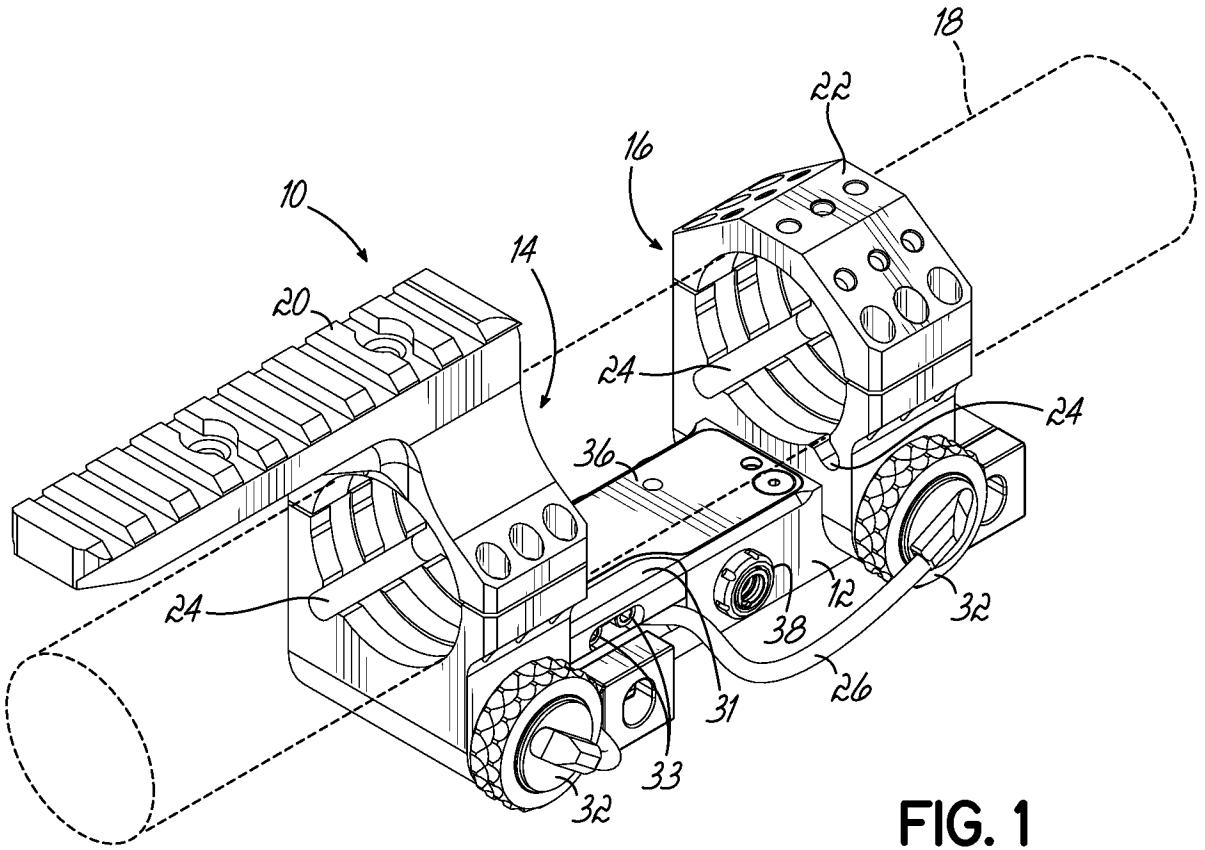
FIG. 1 is an isometric view of a unitary scope mount with electrical connectivity hub according to one embodiment of the present invention.
Figure 2:
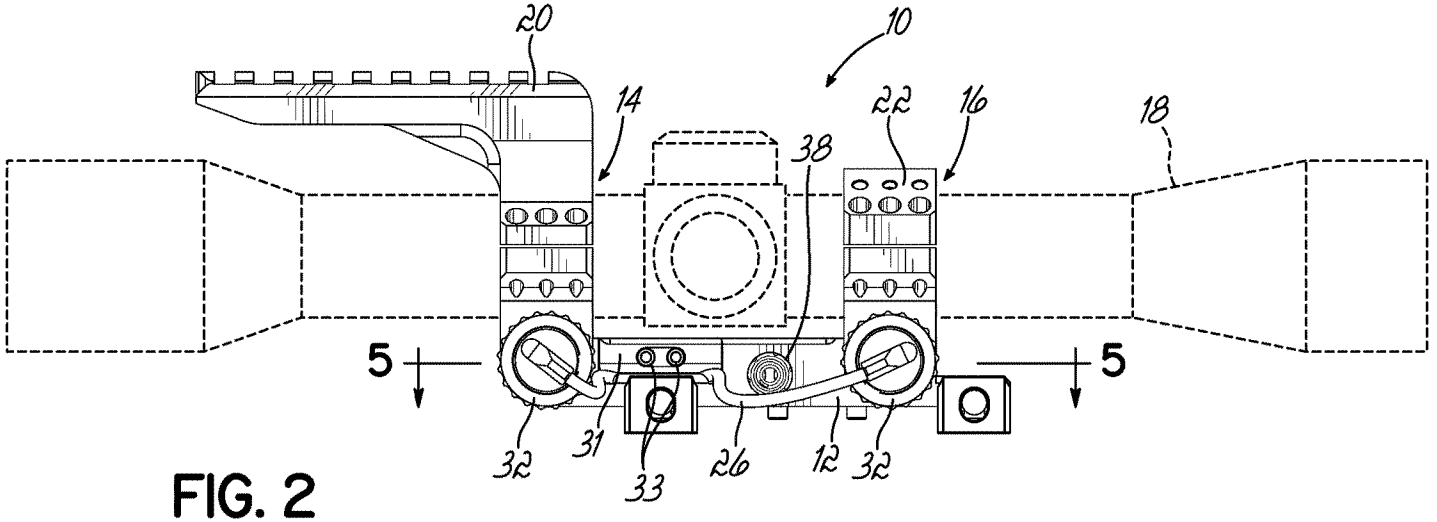
FIG. 2 is a left side view thereof.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Referring to the various drawing figures, and first to FIG. 1-4, therein is shown a unitary scope mount 10 with an electrical connectivity hub according to one embodiment of the present invention. The mount 10 includes a base portion 12 configured to be clamped in a well-known manner to a MIL-STD 1913 (Picatinny) accessory rail (not shown). Secured to or integral with the base portion are front and rear scope mounting rings 14, 16 to firmly engage the barrel of a scope 18 (shown in phantom line). The rings 14, 16 may be of any desired style or construction, including those that will accept standard scope tube diameters and that may be formed in separable parts that can be clamped together with threaded fasteners according to any of several well-known constructions. The mounting rings 14, 16 can accept adaptable ring caps, such as a ruggedized accessory platform (RAP) 20 that provides an elevated mounting rail for positioning a laser rangefinder or other device with adequate clearance relative to the objective bell of the scope 18. Alternatively, the ring cap could provide a multi-mount platform 22 to which a mounting rail or base may be selectively positioned and connected at top or 45° offset positions for short range or back-up sighting devices, or the ring cap could include, for example, a bubble level, cant indicator, and/or attachment for an angle degree indicator.

Figure 4:
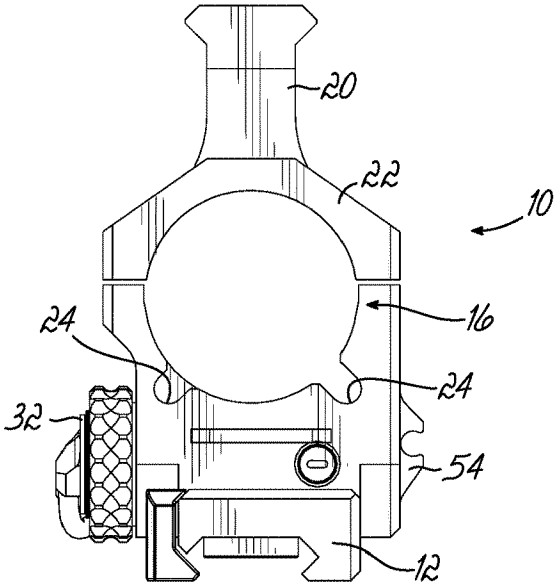
FIG. 4 is a rear end view thereof.

As best illustrated in FIGS. 1 and 4, the rings 14, 16 may include longitudinal, interior channels 24 through which wires or cables may be passed in a secure way to minimize the need for securing them with secondary devices or routing them to the side or top of the rings 14, 16 where they are susceptible to damage or snagging. Additionally, exterior longitudinal channels (not shown) may be provided to allow protected passage of wires or cables between positions forward and rearward of a mounting ring 14, 16.

Within the base portion 12, such as at the longitudinal locations of the front and rear rings 14, 16, transverse chambers 28 may be provided to receive cylindrical batteries, such as the 3-volt CR123A. The batteries 30 may be held in place, such as by a removable cap 32 having a threaded or bayonet lug engagement with the open end of the battery chamber 28 with electrical connections. The batteries 30 may be connected in parallel or series (shown) to provide, for example 6 volts DC, internally or externally, such as with the illustrated jumper wire 26. This wire 26 may be secured to the base 12, such as with a removable retainer 31 held with threaded fasteners 33. Spring connections to terminals of the batteries 30 provide compression on the batteries 30 and resist interruption of power during recoil of the weapon system (not shown) to which the mount 10 may be attached.

Figure 5:
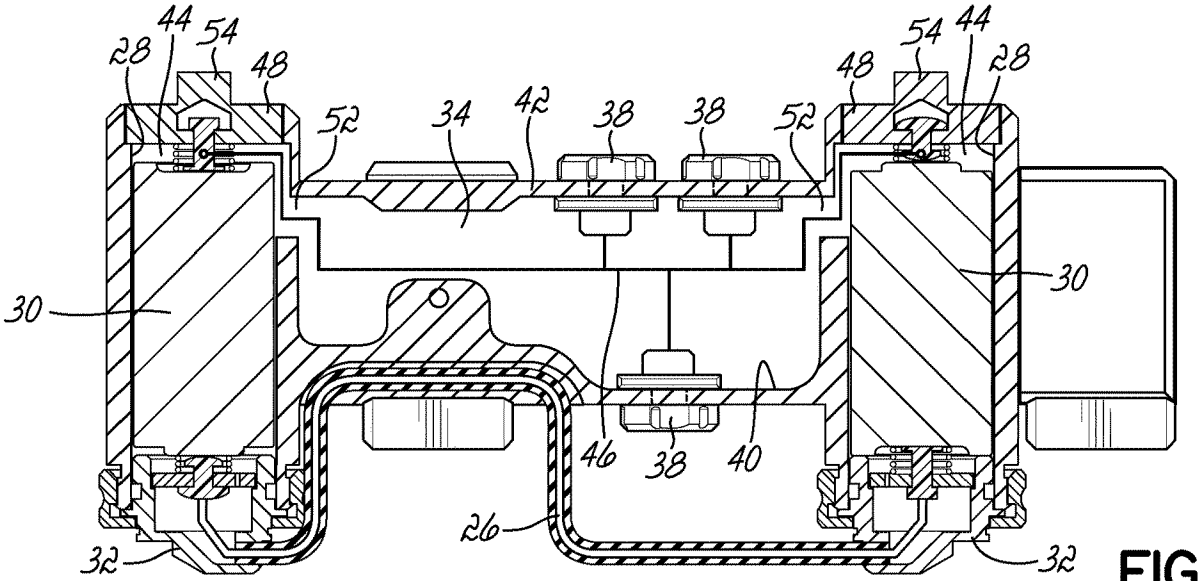
FIG. 5 is a top sectional view taken substantially along line 5-5 of FIG. 2 schematically illustrating internal electrical connectivity of connector sockets and batteries.

The base portion 12 may also include a central chamber 34, accessible, for example, through a top opening that may be closed with a cover panel 36. If desired or deemed necessary, a gasket or O-ring (not shown) can be used to provide a watertight seal. Connectors 38, such as multi-conductor sockets for operatively receiving connector plugs, may be provided through side walls 40, 42 of the chamber 34 in the base portion 12. These may be, for example, Nano 360® Circulars Break Away panel mount connectors sold by Omnetics Connector Corporation of Minneapolis, Minn. (http://omnetics.com). As schematically illustrated in FIG. 5, the connectors 38 may be operatively connected with each other and/or to the internal batteries 30 or external power sources (not shown). One or more printed circuit boards (PCBs) may be used for facilitating secure connections. Alternatively, a separate housing unit for the connectors may attach to the base 12 in a manner that allows it to be swapped as desired.

Figure 3:
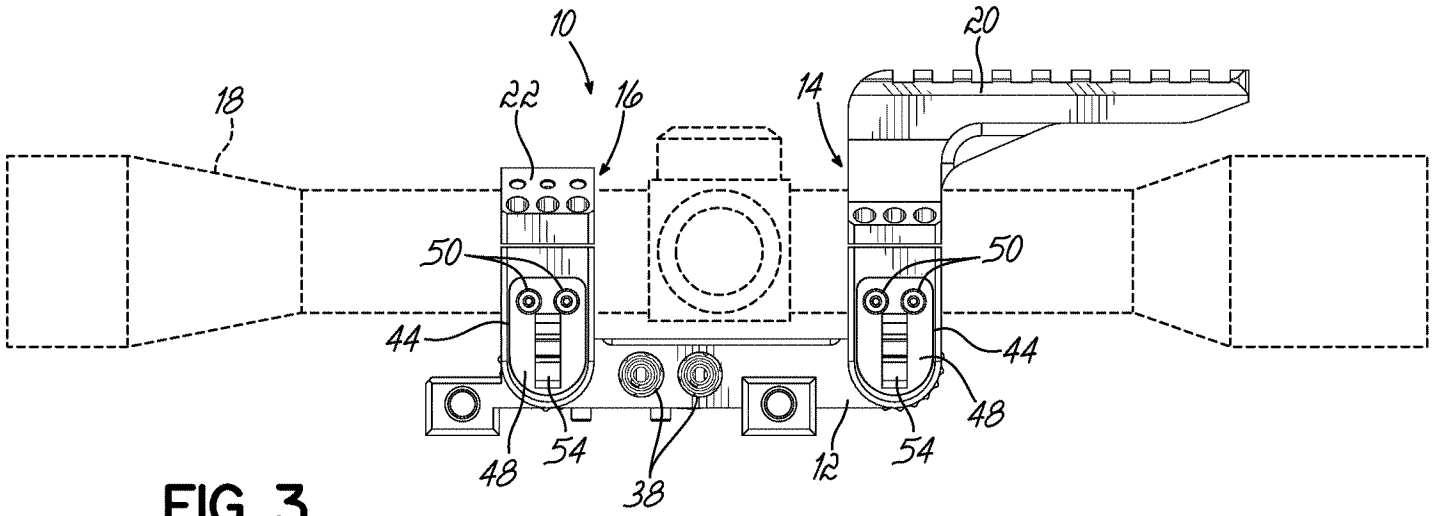
FIG. 3 is a right side view thereof.

Referring now in particular to FIGS. 3 and 5, lateral chambers 44 may be provided, such as in recesses formed in lower portions of the mounting rings 14, 16 and/or the base portion 12. These lateral chambers 44 may house auxiliary devices connected to the bus 46. Such devices may include environmental sensors located here to be away from heat sources, a Bluetooth® or other antenna, such as GPS, for maximum communication distance and reduced interference. The lateral chambers 44 can be accessed without demounting of the scope 18 through a removable cover 48 attached, such as with threaded fasteners 50. Optionally, the covers 48 may include exterior cable management clips 54. The lateral chambers 44 may be contiguous with the battery chambers 28 and may interconnect with the central chamber 34 via internal passageways 52.

The mount 10 of the illustrated embodiment provides secure retention of the riflescope 18 in a profile that is not significantly larger or heavier than an ordinary unitary mount. Additionally, it can still provide an optimal 1.54 inch (39 mm) optical center height, allowing the riflescope 18 to be used in optical alignment with modern night vision and thermal imaging devices mounted to the same weapon system rail. The mount 10 minimizes the amount of mounting rail space that is used for mounting other required components necessary to effectively operate a riflescope with an internal or external data display, in conjunction with a rangefinder, ballistic calculator, and/or environmental sensors. Traditional options require the use of a secondary battery pack and usually force the user to mount the rangefinder or other device on a hand guard rail or other location of the weapon system. The integration of battery power supply and power/data bus with selectable connectors allow the shortest possible electrical cables to be used. Along with the integrated cabling channels 24, 26, this minimizes or eliminates the need for using zip-ties or other cable management tools or devices to secure wires and prevent snagging or damage during normal use.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. An optical aiming scope mount, comprising:

a scope mount base configured to be removably attachable to a weapon system accessory rail;

at least two longitudinally spaced apart scope mounting rings unitary with the scope mount base and extending vertically therefrom;

a first chamber formed in a portion of the scope mount base; and a plurality of transversely and horizontally oriented electrical connectors on the scope mount base adapted to be positioned beneath a scope mounted in the scope mounting rings such that the electrical connectors are operatively accessible while the scope is mounted in the scope mounting rings and while the scope mount base is attached to the weapon system accessory rail, the electrical connectors operatively joined by a circuit at least partially located in the first chamber to provide a power and data distribution bus for multiple electrical devices.

2. An optical aiming scope mount, comprising:

a base configured to attach to a weapon system;

at least two longitudinally spaced apart scope mounting rings on the base;

a first chamber formed in a portion of the base; and a plurality of electrical connectors on the base operatively accessible while a scope is mounted in the scope mounting rings operatively joined by a circuit at least partially located in the first chamber to provide a power and data distribution bus for multiple electrical devices, further comprising at least one longitudinal cable channel on an inner surface of at least one of the scope mounting rings that secures a cable between the mounting ring and a mounted scope.

3. The mount of claim 1, the base further comprising at least one battery chamber operably connected to the first chamber.

4. The mount of claim 3, further comprising a battery in the battery chamber operably connected to the circuit.

5. The mount of claim 1, further comprising at least one lateral chamber in the base accessible without demounting a scope from the rings.

6. The mount of claim 5, wherein the lateral chamber is operably connected to the first chamber.

7. An optical aiming scope mount, comprising:

a scope mount base configured to be removably attachable to a weapon system accessory rail;

at least two longitudinally spaced apart scope mounting rings unitary with the scope mount base and extending vertically therefrom;

a main compartment formed in a portion of the scope mount base;

a plurality of transversely and horizontally oriented electrical connectors on the scope mount base adapted to be positioned beneath a scope mounted in the scope mounting rings such that the electrical connectors are operatively accessible while the scope is mounted in the scope mounting rings and while the scope mount base is attached to the weapon system accessory rail;

at least one battery compartment positioned either forward or aft of the main compartment, communicating with the main compartment, and adapted to receive a battery therein; and a circuit at least partially located in the main compartment and adapted to operably join the battery with the electrical connectors to provide a power and data distribution bus for multiple electrical devices when connected to the electrical connectors.

8. The mount of claim 7, wherein the at least one battery compartment is transversely and horizontally oriented in the scope mount base.

9. The mount of claim 8, further comprising a removable cap at one end of the battery compartment and on one lateral side of the scope mount base, the cap adapted to permit insertion and removal of the battery into and from the battery compartment, the battery compartment adapted to be positioned beneath a scope mounted in the scope mounting rings such that the cap is operatively accessible while the scope is mounted in the scope mounting rings and while the scope mount base is attached to the weapon system accessory rail.

10. The mount of claim 9, further comprising an auxiliary device compartment at the other end of the battery compartment and communicating with the battery compartment, and a removable cover on the other lateral side of the scope mount base adapted to permit insertion and removal of an auxiliary device into and from the auxiliary device compartment, the cover being operatively accessible while the scope is mounted in the scope mounting rings and while the scope mount base is attached to the weapon system accessory rail.

11. The mount of claim 10, wherein the circuit is adapted to operably join the battery with the auxiliary device.

12. An optical aiming scope mount, comprising:

a scope mount base configured to be removably attachable to a weapon system accessory rail;

at least two longitudinally spaced apart scope mounting rings unitary with the scope mount base and extending vertically therefrom;

a main compartment formed in a portion of the scope mount base;

a plurality of transversely and horizontally oriented electrical connectors on the scope mount base adapted to be positioned beneath a scope mounted in the scope mounting rings such that the electrical connectors are operatively accessible while the scope is mounted in the scope mounting rings and while the scope mount base is attached to the weapon system accessory rail;

a first battery compartment positioned forward of the main compartment, communicating with the main compartment, and adapted to receive a first battery therein;

a second battery compartment positioned aft of the main compartment, communicating with the main compartment, and adapted to receive a second battery therein; and a circuit at least partially located in the main compartment and adapted to operably join the batteries with the electrical connectors to provide a power and data distribution bus for multiple electrical devices when connected to the electrical connectors.

13. The mount of claim 12, wherein the battery compartments are transversely and horizontally oriented in the scope mount base.

14. The mount of claim 13, further comprising a removable cap at one end of each battery compartment and on one lateral side of the scope mount base, each cap adapted to permit insertion and removal of the battery into and from a respective battery compartment, each battery compartment adapted to be positioned beneath a scope mounted in the scope mounting rings such that the caps are operatively accessible while the scope is mounted in the scope mounting rings and while the scope mount base is attached to the weapon system accessory rail.

15. The mount of claim 14, further comprising an auxiliary device compartment at the other end of each battery compartment and communicating with a respective battery compartment, and a removable cover on the other lateral side of the scope mount base for each auxiliary device compartment and adapted to permit insertion and removal of an auxiliary device into and from a respective auxiliary device compartment, the covers being operatively accessible while the scope is mounted in the scope mounting rings and while the scope mount base is attached to the weapon system accessory rail.

16. The mount of claim 15, wherein the circuit is adapted to operably join the batteries with the auxiliary devices.

* * * * *